United States Patent [19]

Ramich

[11] 4,200,219

[45] Apr. 29, 1980

[54] CONTAINER FOR LIQUID PRODUCT

[75] Inventor: Gary A. Ramich, Neenah, Wis.

[73] Assignee: American Can Company, Greenwich, Conn.

[21] Appl. No.: 48,881

[22] Filed: Jun. 15, 1979

[51] Int. Cl.[2] ..... B65D 5/24; B65D 3/00

[52] U.S. Cl. ..... 229/16 A; 229/21; 229/1.5 B

[58] Field of Search ..... 229/1.5 B, 21, 16 A, 229/8, 4.5, 5.6, 53

[56] References Cited

U.S. PATENT DOCUMENTS

| | | | |
|---|---|---|---|
| 1,180,330 | 4/1916 | Spaulding | 229/53 |
| 1,281,038 | 10/1918 | McGhee | 229/53 |
| 2,168,186 | 8/1939 | Adamson | 229/21 |
| 2,240,599 | 5/1941 | Amberg | 229/21 X |
| 3,633,814 | 1/1972 | Michetti | 229/1.5 B |
| 4,020,988 | 5/1977 | Kipp | 229/1.5 B X |

*Primary Examiner*—Davis T. Moorhead

*Attorney, Agent, or Firm*—Robert P. Auber; Ira S. Dorman; Thomas D. Wilhelm

[57] ABSTRACT

A container for liquid product, such as yogurt or other dairy products, is disclosed which is formed of a single sheet of paperboard folded into a cup-like container. The container includes a front and a back panel which are folded into a tubular shape and are sealed together along their side edges. At the bottom of the container, an infolding flap arrangement is provided, and an anti-leak tab is formed along the bottom edge of the front panel of the container to be inserted between the infolding flaps at the bottom of the container and the rear panel to inhibit fluid leaks from the bottom of the container.

8 Claims, 6 Drawing Figures

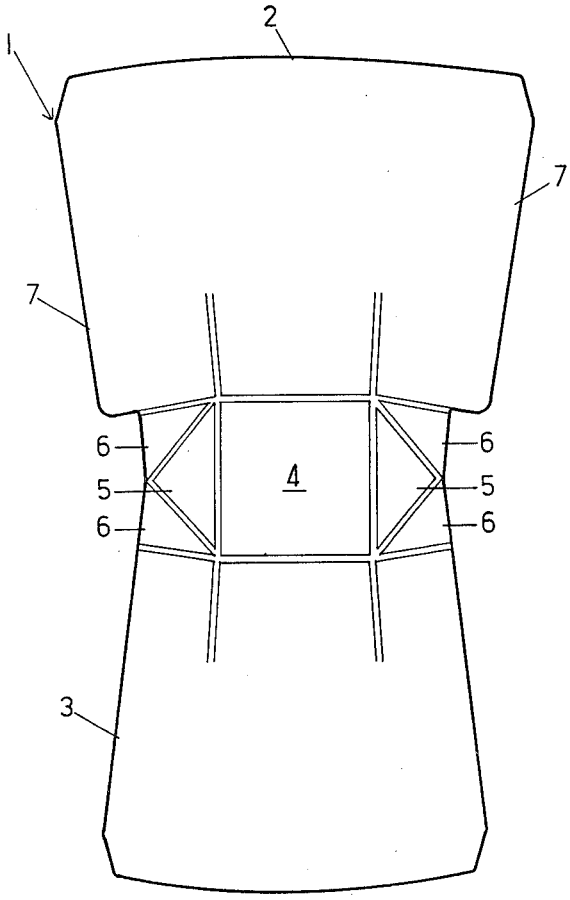
PRIOR ART FIG. 1
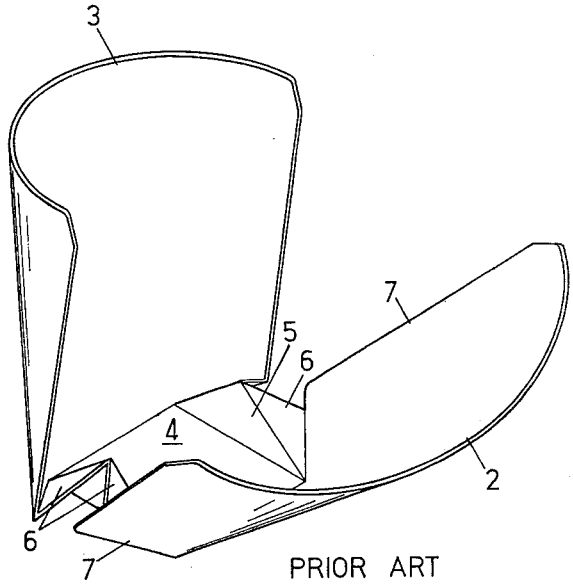
PRIOR ART FIG. 2
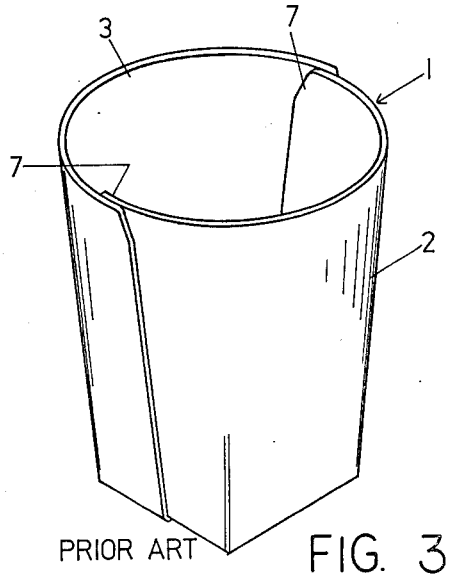
PRIOR ART FIG. 3

CONTAINER FOR LIQUID PRODUCT

BACKGROUND OF THE INVENTION

1. Field of the Invention

The present invention relates to containers in general and in particular, to cup-like containers for dairy products and other liquid materials.

2. Description of the Prior Art

The prior art is generally cognizant of the use of cup-like containers for use by in merchandising product and also for use as drinking cups. Examples of such containers are shown in U.S. Pat. No. 1,050,100, U.S. Pat. No. 1,073,481, U.S. Pat. No. 1,129,364, U.S. Pat. No. 1,953,884, U.S. Pat. No. 2,168,186, U.S. Pat. No 2,240,599, U.S. Pat. No. 2,577,109, and U.S. Pat. No. 3,381,877.

There are also examples in the prior art of such containers in which a pair of panels forming the opposite sides of the container are joined by a bottom panel and also by infolding bottom side flaps designed to seal the sides of the bottom of the container. An example of such a container is shown in U.S. Pat. No. 4,020,988.

Shown in FIGS. 1–3 is a paperboard cup-type container for liquid product, generally indicated at 1, which is prior art to the container of the present invention. The blank for the container 1, as shown in FIG. 1, includes a pair of front and back panels 2 and 3 with the front panel 2 being slightly wider than the rear panel 3. The panels 2 and 3 are joined at their bottom edges by a bottom panel 4. Along each side edge of the bottom panel 4 an infolding flap construction formed of a triangular infolding side bottom flap 5 and a pair of gusset flaps 6 is formed joining the bottom panel 4 to each of the front panel 2 and the rear panel 3. A pair of side flap extensions 7 are formed along the sides of the front panel 2. As can be seen in FIG. 2, the blank of FIG. 1 is assembled into the cup 1 of FIG. 3 by folding up the front and rear panels 2 and 3 and infolding the bottom side flaps 5 with the gusset flaps 6 being folded behind the infolding flaps 5. The side flap extensions 7 of the front panel 3 are inserted inside of the rear panel 3 and are sealed thereto while the gusset flaps 6 are secured to the inside of the rear panel 3 to construct the cup 1 as shown in FIG. 3.

SUMMARY OF THE INVENTION

The present invention is summarized in that a paperboard container for liquid product includes a front panel having a pair of side edges and a bottom edge, a rear panel having a pair of side edges and a bottom edge, a sealing flap extension formed on each of the side edges of the front panel, the sealing flap extensions being sealed to the side edges of the rear panel such that the front and rear panels are shaped to form a tubular container, a bottom panel extending between the bottom edges of the front and rear panels to close the bottom of the container, the bottom panel having a pair of side edges, a triangular infolding bottom side flap attached to each of the side edges of the bottom panel and folded upward into the interior of the container, a pair of gusset flaps connecting each of the bottom side flaps to each of the front and rear panels, the gusset flaps being folded against the adjacent bottom side flap, and an anti-leak tab extending outward from each of the sealing flap extensions on the front panel at the bottom portion thereof, the anti-leak tabs each being positioned between and sealed to the adjacent gusset flaps and the inside of the rear panel to inhibit fluid flow therebetween.

It is an object of the present invention to construct a cup-type container for a liquid product in which a secure and leak-resistant bottom edge seal is simply and efficiently formed.

It is another object of the present invention to provide such a cup with such a leak-resistant seal at a minimal cost and with a maximum efficiency.

Other objects, features, and advantages of the present invention will become apparent from the following specification when taken in conjunction with the accompanying drawings.

BRIEF DESCRIPTION OF THE DRAWINGS

FIG. 1 is a plan view of a blank for use in constructing a container in accordance with the prior art.

FIG. 2 is a perspective illustration of an intermediate step in constructing a container from the blank of FIG. 1.

FIG. 3 is a perspective view of a container in accordance with the prior art.

DESCRIPTION OF THE PREFERRED EMBODIMENT

Figure 4:
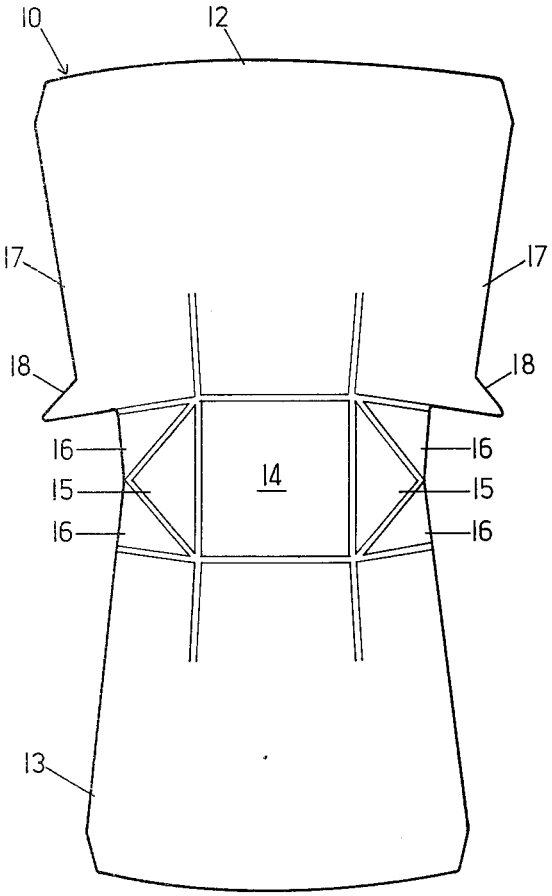
FIG. 4 is a blank for use in constructing a container in accordance with the present invention.

Shown in FIG. 1 is a paperboard blank, generally indicated at 10, for use in constructing a paperboard container for liquid product in accordance with the present invention. The blank 10 generally includes a front panel 12 and a rear panel 13, both formed of a relatively large size and having diverging side edges and generally aligned and spaced apart bottom edges. A bottom panel 14, of a generally square shape, is provided connecting a portion of each of the bottom edges of the front panel 12 and the rear panel 13 to each other. The bottom panel 14 also has a pair of side edges to each of which is attached a respective one of a pair of infolding side bottom flaps 15. The side bottom flaps 15 are each formed in a generally triangular shape with the longest side of such triangle being colinear with the respective side edge of the bottom panel 14. Connecting the other two edges of each of the infolding bottom side flaps 15 with the adjacent bottom edges of the front panel 12 and the rear panel 13 are gusset flaps 16. Two of the gusset flaps 16 are associated with each infolding bottom side flap 15 to connect that bottom side flap 15 with the bottom edge of each of the front panel 12 and the rear panel 13. Along each of the side edges of the front panel 12 a sealing flap extension 17 is formed extending outward the sides of the front panel 12 to make the front panel 12 wider than the rear panel 13. Extending laterally outward from a bottom portion of each of the sealing flap extension 17 is an anti-leak tab 18. The antileak tabs 18 are each formed in a generally triangular shape having their bottom edge being a generally linear extension of the bottom edge of the front panel 12. The anti-leak tabs 18 are sized so that the length of the long side of each of the adjacent bottom side flaps 15 is approximately equal to the length of the bottom edge of the front panel 12 beginning adjacent to the corner of the bottom flap 14 and continuing out to the end of the anti-leak tab 18. The reason for this sizing will be apparent below.

Figure 5:
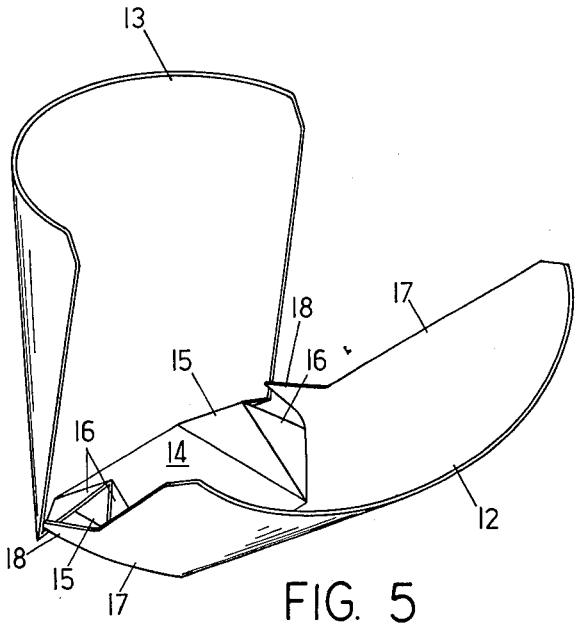
FIG. 5 is an intermediate step in constructing the container from the blank of FIG. 4.
Figure 6:
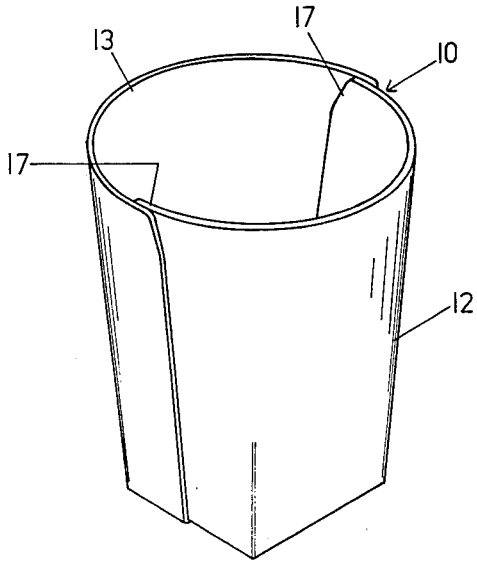
FIG. 6 is a container constructed in accordance with the present invention.

Shown in FIG. 5 is the method for erecting the blank of FIG. 4 into the finished container for liquid product 10 as shown in FIG. 6. The front panel 12 and the rear panel 13 are each folded upward relative to the bottom panel 14. At the same time, the infolding side bottom flaps 15 are folded upward into the interior of the container with the adjacent gusset flaps 16 being folded behind the side bottom flaps 15 inside of the adjacent front panel 12 or rear panel 13. As the front panel 12 and the rear panel 13 are folded together, the sealing flap extensions 17 are inserted inside of the side edges of the rear panel 13 and are sealed thereto preferably by heat sealing although adhesive bonding is also usable. As the sealing flap extensions 17 are inserted inside of the side edges of the rear panel 13, the anti-leak tabs 18 are inserted also inside of the rear panel 13 between the rear panel 13 and the adjacent gusset flaps 16 connecting the rear panel 13 to the two bottom side flaps 15. The anti-leak tabs 18 rest in the finished container 10 with their bottom edges lying along the scoreline connecting the opposite gusset flap 16 to the rear panel 13 and are secured by the heat sealing process to the inside of the rear panel 13 and to both of the gusset flaps 16. The length of the anti-leak tabs 18 ensures that the anti-leak tabs 18 extend along the entire distance of both of the gusset flaps 16 adjacent thereto so that the far end of each of the anti-leak tabs 18 is positioned adjacent to the junction at the corner of the bottom panel 14 connecting the bottom panel 14 to each of the rear panel 13 the side bottom flap 15 and the gusset flap 16.

The container 10, as shown in FIG. 6, functions as a secure leak-resistant container for liquid product such as yogurt or other dairy products. The provision for the anti-leak tabs 18 helps to prevent the container 10 from leaking product in a fashion that commonly occurs in containers of this type. In other similar containers, liquid product can "channel" or be drawn by capillary action between the rear panel and the adjacent gusset flap since there is very often a gap between these components at the marginal side edge of the front panel. In the container 10, the provision for the anti-leak tabs 18 insures that the gaps or imperfect seals which might otherwise exist between the rear panel 13 and the gusset flaps 16 at the marginal side edges of the extensions 17 of the front panel 12 are sealed. This provision for the anti-leak tabs 18 is sufficient to insure that such channelling or capillary action does not take place and that all components of the bottom of the container 10 may securely be sealed together. This result is extremely advantageous in the use of such containers for liquid product in that the shelf life of the container is greatly enhanced and the consumer exceptance of the product in such container is also greatly increased. These results are accomplished with a minimal requirement of additional stock material and no additional cost or complication in the construction and erection of the container itself.

It is understood that the present invention is not limited to the particular construction and arrangement of parts disclosed and illustrated herein, but embraces all such modified forms thereof that come within the scope of the following claims.

I claim:

1. A paperboard container for liquid product comprising:

(a) a front panel having a pair of side edges and a bottom edge;

(b) a rear panel having a pair of side edges and a bottom edge;

(c) a sealing flap extension formed on each of the side edges of the front panel, the sealing flap extensions being sealed to the side edges of the rear panel such that the front and rear panels are shaped to form a substantially cylindrical container;

(d) a bottom panel extending between the bottom edges of the front and rear panels to close the bottom of the container, the bottom panel having a pair of side edges;

(e) a triangular infolding bottom side flap attached to each of the side edges of the bottom panel and folded upward into the interior of the container;

(f) a pair of gusset flaps connecting each of the bottom side flaps to each of the front and rear panels, the gusset flaps being folded against the adjacent bottom side flap; and (g) an anti-leak tab extending outward from each of the sealing flap extensions on the front panel at the bottom portion thereof, the anti-leak tabs each being positioned between the adjacent gusset flaps and the inside of the rear panel to inhibit fluid flow therebetween.

2. The paperboard container of claim 1 wherein each of the anti-leak tabs is triangular in shape.

3. The paperboard container of claim 1 wherein the bottom edge of each of the anti-leak tabs is an extension of the bottom edge of the front panel.

4. The paperboard container of claim 3 wherein each of the anti-leak tabs is of sufficient length to extend to the end of the adjacent bottom side flap adjacent to the rear panel.

5. A paperboard blank adapted for erection into a container for liquid product, the blank comprising:

(a) a front panel having a pair of side edges and a bottom edge;

(b) a rear panel having a pair of side edges and a bottom edge;

(c) a bottom panel extending between the bottom edges of the front and rear panels, the bottom panel having a pair of side edges;

(d) a triangular infolding bottom side flap attached to each of the side edges of the bottom panel;

(e) a pair of gusset flaps attached to each of the bottom side flaps connecting each of the bottom side flaps to the bottom edges of each of the front and rear panels;

(f) a sealing flap extension formed along each of the side edges of the front panel; and (g) an anti-leak tab extending outward from each of the sealing flap extensions, the anti-leak tabs being adapted to be folded between the interior of the rear panel and the adjacent gusset flaps in the erected container to inhibit fluid flow therebetween.

6. The paperboard blank of claim 5 wherein each of the anti-leak tabs is triangular in shape.

7. The paperboard blank of claim 5 wherein the bottom edge of each of the anti-leak tabs is an extension of the bottom edge of the front panel.

8. The paperboard blank of claim 7 wherein each of the anti-leak tabs is sufficiently long so as to extend to the end of the adjacent bottom side flap adjacent to the rear panel when the container is erected.

* * * * *